US006747540B1

(12) United States Patent
Nakase et al.

(10) Patent No.: US 6,747,540 B1
(45) **Date of Patent: *Jun. 8, 2004**

(54) IGNITION COIL FOR INTERNAL COMBUSTION ENGINE

(75) Inventors: Yosimi Nakase, Anjo (JP); Shigemi Itou, Toyota (JP); Masahiro Kondou, Toyohashi (JP)

(73) Assignee: Denso Corporation, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1067 days.

(21) Appl. No.: 08/951,317

(22) Filed: Oct. 16, 1997

(30) Foreign Application Priority Data

Oct. 18, 1996 (JP) ..... 8-257677
Apr. 22, 1997 (JP) ..... 9-104370

(51) Int. Cl.[7] ..... H01F 27/29

(52) U.S. Cl. ..... 336/192; 336/90; 336/96; 336/107

(58) Field of Search ..... 336/198, 208, 336/192, 96, 107; 123/634

(56) References Cited

U.S. PATENT DOCUMENTS 3,949,338 A * 4/1976 Burson ..... 336/107
4,352,079 A * 9/1982 Mueller et al. ..... 336/198
4,514,712 A * 4/1985 McDougal ..... 336/107
4,893,105 A * 1/1990 Maeda et al. ..... 336/198
5,144,935 A * 9/1992 Taruya et al. ..... 123/634
5,349,320 A * 9/1994 Suzuki et al. ..... 336/107
5,778,863 A * 7/1998 Oosuka et al. ..... 123/634

FOREIGN PATENT DOCUMENTS

| | | |
|---|---|---|
| EP | 0297487 A | 1/1989 |
| EP | 0703588 | 3/1996 |
| GB | 2199193 | 6/1988 |
| JP | 44-19685 | 8/1969 |
| JP | 56-71915 | 6/1981 |
| JP | 57-212371 | * 12/1982 |
| JP | 61-140518 | 8/1986 |
| JP | 61-191007 | 8/1986 |
| JP | 63-195710 | 12/1988 |
| JP | A-2-23269 | 1/1990 |
| JP | A-8-97057 | 4/1996 |
| JP | 08-203757 | 8/1996 |
| JP | 10-074645 | 3/1998 |

OTHER PUBLICATIONS

Patent Abstracts of Japan, vol. 096, No. 008, Aug. 30, 1996 & JP 08 107027A (Nippondenso Co Ltd), Apr. 23, 1996.

* cited by examiner

*Primary Examiner*—Tuyen T. Nguyen
(74) *Attorney, Agent, or Firm*—Nixon & Vanderhye

(57) ABSTRACT

A conductive member is disposed between a secondary spool and a high tension terminal to shield the wire connecting the secondary coil and the high tension terminal. The conductive member has a wide surface facing the low tension components to moderate the electric field strength around low tension components, thereby preventing treeings from growing in the insulating filler of the ignition coil.

12 Claims, 6 Drawing Sheets

IGNITION COIL FOR INTERNAL COMBUSTION ENGINE

CROSS REFERENCE TO RELATED APPLICATION

The present application is based on and claims priority from Japanese Patent Applications Hei 8-275677, filed on Oct. 18, 1996 and Hei 9-104370, filed on Apr. 22, 1997, the contents of which are incorporated herein by reference.

BACKGROUND OF THE INVENTION

1. Field of the Invention

The present invention relates to an ignition coil for an internal combustion engine, particularly, a stick-like ignition coil installed directly in the plug holes of an internal combustion engine.

2. Description of the Related Art

A high tension terminal of a conventional stick-like ignition coil for an internal combustion engine (hereinafter referred to as the ignition coil) is shown in FIG. 9.

A secondary coil 600 is wound around a secondary spool which has a flange member 603 and a high tension output terminal 602 for providing a high tension voltage generated by the secondary coil 600. A core is inserted in the secondary spool, which usually projects from the secondary coil 600 toward the high tension output terminal, and a spacer portion 604 is formed between the secondary coil 600 and the high tension terminal 602.

If permanent magnets are fixed to an end of the core, the spacer portion 604 becomes longer.

The secondary coil 600 and the high tension output terminal 602 are connected by a lead wire 601 extending from the end of the secondary coil through the spacer portion 604.

However, the stick-like ignition coil has such a small diameter that the low tension primary coil, the core and a portion of the engine block are close to one another. In addition, a surface of the lead wire 601 facing the low tension portion or components is so small that the electric field strength around the lead wire becomes very high.

If a high tension voltage is generated by the secondary coil 600, electric breakdown may arise between the lead wire 601 and the low tension portion, thereby causing failure in supplying high tension voltage to the spark plugs (not shown).

In an ignition coil insulated by insulating resin, a "tree" is produced around the lead wire as a result of the electric discharge in the insulating resin and may extend to the low tension components. If the tree bridges the high tension lead wire and the low tension components, the high tension voltage can not be supplied to the spark plugs.

SUMMARY OF THE INVENTION

A main object of the present invention is to provide a highly reliable ignition coil which prevents the electric breakdown between high tension portions or components and low tension portions or components.

According to a feature of the present invention, a conductive member is disposed around the portion connecting the secondary coil and the high tension terminal to provide a wide surface area facing low tension components enough to moderate the electric field strength around the connecting section, thereby preventing electric discharge between the connecting section and the low tension components. As a result, a highly reliable ignition coil is provided.

According to another feature of the present invention, the conductive member comprises a cylindrical coil of a wire extended from the secondary coil toward the high tension terminal. Accordingly, a wide surface area of the connecting member is provided in the winding step of the secondary coil without addition of specific steps.

According to another feature of the present invention, the connecting member comprises a cylindrical conductive member which covers the wire connecting the secondary coil and the high tension terminal.

If the adhesive strength of the insulating resin and the primary spool is not enough and the two members are separated from each other due to thermal expansion and contraction, the growing speed of the "treeing" increases in proportion to the length of the separation.

According to another feature of the present invention, the primary spool is made of a material which is bonded to the epoxy resin at a high adhesive strength so that the separation between the insulating resin and the primary spool can be prevented. As a result, even if the treeing grows from a crack and reaches the primary spool, the treeing must bypass the primary spool, so that the time for the treeing to reach the low tension components increases. In other words, time of the electric breakdown is delayed, thereby increasing the life time of the ignition coil.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A first embodiment is described with reference to FIGS. 1 and 2.

Figure 1:
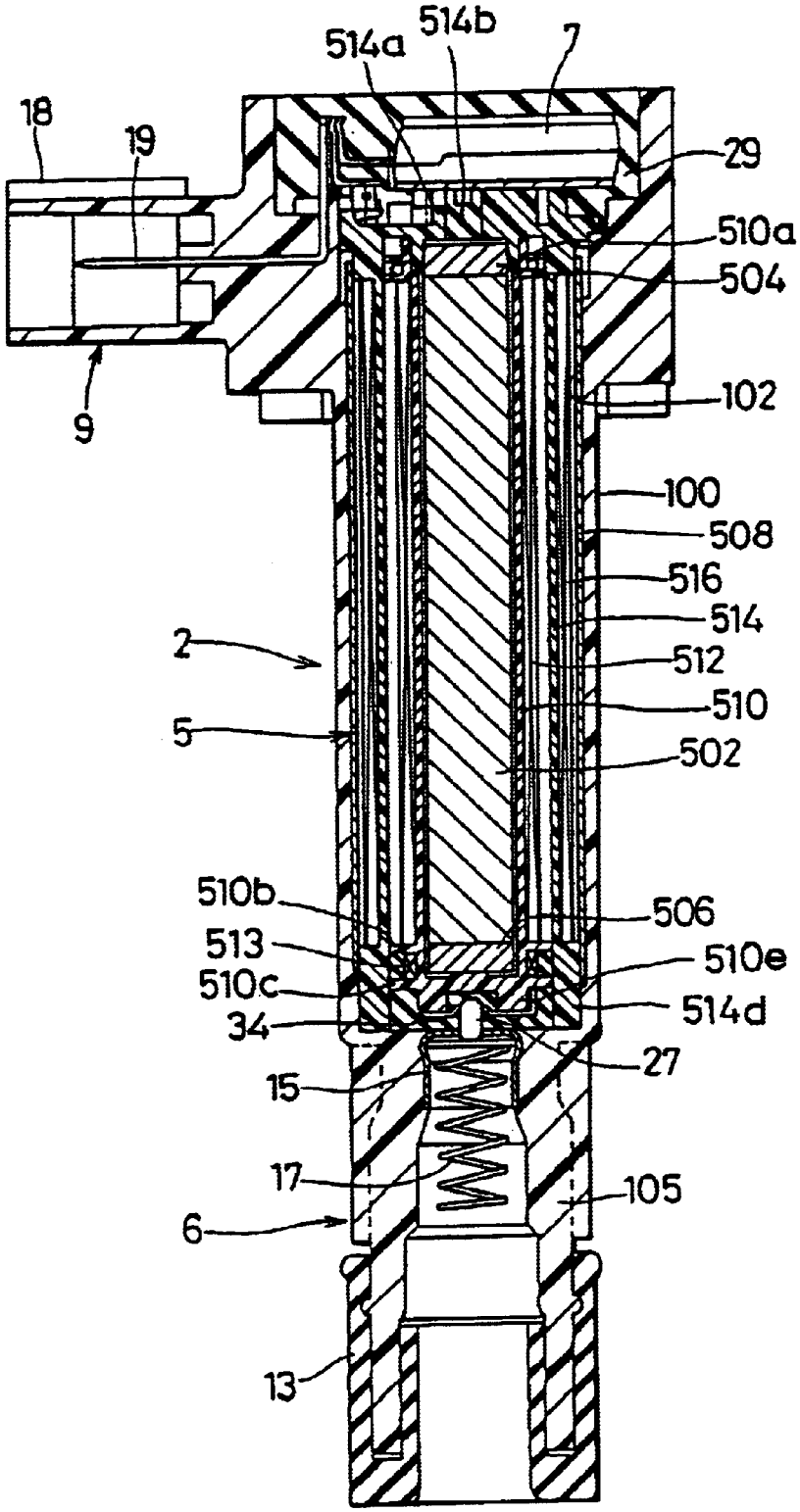
FIG. 1 is a sectional view illustrating an ignition coil according to a first embodiment of the present invention.
Figure 2:
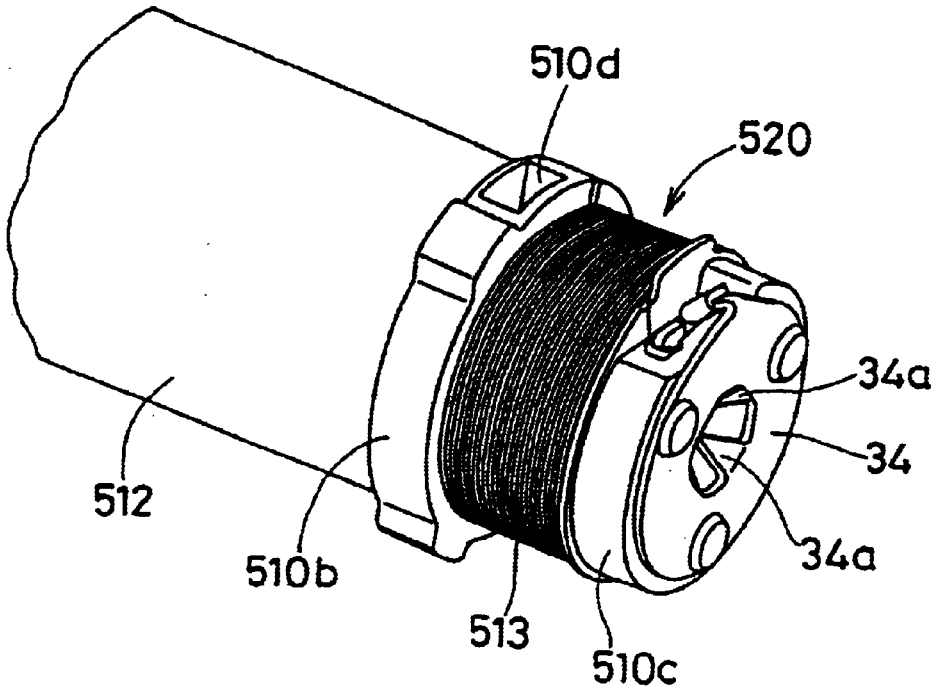
FIG. 2 is a perspective view illustrating a secondary coil, a connecting member and a high tension terminal of the ignition coil according to the first embodiment.

An ignition coil 2 is mounted on a spark plug at a lower portion thereof in FIG. 1, and the spark plug is installed in one of plug holes formed on an upper portion of the engine block for each one cylinders.

The ignition coil 2 is composed of a generally cylindrical transformer section 5, a control circuit section 7 disposed at a side of the transformer section opposite the spark plug and a connecting section 6 disposed at the side of the spark plug to supply the secondary voltage of the transformer section 5 to the spark plug. The control circuit section 7 switches on and off the primary current supplied to the primary coil at suitable timings to provide high tension voltage supplied to the spark plug.

The ignition coil 2 has a cylindrical case 100 made of resinous material, which has a compartment 102 for the transformer section 5 and the control circuit section 7. The compartment 102 is filled with epoxy resin 29 to insulate the transformer section 5 and the control circuit section 7.

A connector 9 for receiving a control signal is composed of a connector housing 18 and connector pins 19, and is disposed at an upper portion of the compartment 102 in FIG. 1. The connector housing 18 is integrated with the case 100, and the three connector pins 19 are insert-molded with the connector housing 18 to pass through the case 100 to be connected to outside members.

A lower end of the compartment is closed by a cup 15. The cup 15 is made of conductive metal and is insert-molded in the case 100. A cylindrical member 105 is disposed at the bottom of the case 100 to cover the outer periphery of the cup 15. The compartment 102 and the plug connecting section 6 are hermetically divided by the cup 15. An open end of the plug connecting section 6 is covered by a plug cap 13 made of rubber for receiving a spark plug (not shown).

A compression coil spring 17 is held at the bottom of the cup 15 so that the electrode of the spark plug can engage the lower end of the spring 17.

The transformer section 5 is composed of an iron core 502 disposed at the center thereof, a secondary spool 510 disposed around the iron core 502, a secondary coil 512 wound around the secondary spool, a primary spool 514 disposed around the secondary coil 512 and a primary coil 516 wound around the primary spool 514, and, at opposite ends thereof, permanent magnets 504 and 506. The iron core 502, the magnets 504 and 506 are not connected to the conductive member, and float electrically therefrom.

The iron core 502 is made of thin silicon steel sheets piled up into a column having a circular section. Each of the permanent magnets 504 and 506 is fixed to one of the opposite ends of the iron core 502 so that the polarity thereof becomes opposite to the polarity of the magnetic force generated by the primary coil.

The secondary spool 510 is a resinous cylindrical mold which has a flange portion 510*a* at one end, flange portions 510*b* and 510*c* at the other end and a bottom portion. The flanges 510*b* and 510*c* generally close the lower end portion of the secondary spool 510. The iron core 502 and the permanent magnet 506 are supported by the bottom portion inside the secondary spool 510. The secondary coil 512 is wound around the secondary spool 510 between the flange 510*a* and the flange 510*b* as shown in FIG. 1. A terminal plate 34 forms a high tension terminal and is fixed to the outside of the bottom portion near the flanges 510*b* and 510*c*. A cylindrical dummy coil 513 is disposed between the secondary coil 512 and the terminal plate 34 and is connected by fusing or soldering. The terminal plate 34 has a plurality of nails 34*a* as shown in FIG. 2, and a terminal pin 27 forms the high tension terminal with the terminal plate 34 and engages the nails 34*a* to connect the cup 15 and the terminal plate 34. The high tension voltage generated by the secondary coil 512 is applied to the electrode of the spark plug through the dummy coil 513, the terminal plate 34, the terminal pin 27, the cup 15 and the spring 17. The terminal pin 27 and the terminal plate are covered or immersed in the epoxy resin 29.

The iron core 502 slightly projects from the end of the secondary coil 512 on the side of the terminal plate 34. The secondary coil 512 and the terminal plate 34 are separated by the permanent magnet 506 disposed under the iron core 502 to form a spacer portion 520, where the dummy coil 513 is disposed. The cylindrical dummy coil 513 is formed of the wire extended from the secondary coil, which is wound around the portion between the flanges 510*b* and 510*c*, which are located off to the core 502, to provide a wide surface area and connected to the terminal plate 34.

The primary spool 514 is a resinous cylindrical mold which has a pair of flanges at the opposite ends thereof and a bottom portion. The upper open end of the primary spool 514 is covered by a cover member 514*a*, and the primary coil 516 is wound therearound. The primary spool 514 is disposed to cover the secondary coil 512 around the secondary coil 510, and the lower end 514*d* of the primary spool 514 projects in the axial direction from the lower end 510*e* of the secondary spool 510. The primary spool 514 covers the terminal plate 34 and the portion of the terminal pin 27 being immersed in the epoxy resin 29. It is noted that the lower end 514*d* of the primary spool 514 projects in the axial direction toward the spark plug from an imaginary straight line between the circumference of the terminal pin 27 and the terminal plate 34 and the lower end of an auxiliary core 508. The iron core 502, together with the permanent magnets 504 and 506, extends between the cover member 514*a* of the primary spool 514 and the bottom portion of the secondary spool 510 near the flange 510*c*.

The cover member 514*a* of the primary spool 514 has a plurality of terminal members connected to opposite ends of the primary coil 516 and an end of the secondary coil 512. The terminal members are connected to the connector pin 19 of the connector 9 and to the control circuit section 7. The control circuit section 7 is disposed on the cover member 514*a* and has a plurality of lead wires extending therefrom, which are soldered to the connector pin 19 and the terminal members.

The auxiliary core 508 disposed around the primary spool 514 is formed of a cylindrically wound silicon steel sheet, whose opposite ends are not connected so as to form a longitudinal space. The auxiliary core 508 extends to cover the permanent magnet 506 at one end and the permanent magnet 504 at the other end thereof.

The epoxy resin 29 is filled in the compartment for the transformer section 5 and the control circuit section 7. The epoxy resin 29 is filled through the lower opening of the primary spool 514, an opening 514*b* formed in the middle of the cap 514*a*, an open end of the secondary spool 510 and an opening 510*d* formed in the flange 510*b* to insulate all the spaces among the iron core 502, the secondary coil 512, the primary coil 516 and the auxiliary core 508.

In the above described ignition coil 2, when a primary current supplied to the primary coil 516 is interrupted by the control circuit section 7, a high tension voltage is generated by the secondary coil 512. Since the cylindrical dummy coil 513 provides a large surface facing the low tension components such as the primary coil 516, the auxiliary core 508, the engine block, etc., the electric field strength around the dummy coil 513 can be moderated. Thus, the electric discharge between the dummy coil 513 and the low tension components can be prevented, and the treeing is prevented from growing.

Since the iron core 502, the permanent magnets 504 and 506 float electrically, they are biased by a voltage induced when a high tension voltage is generated by the secondary coil 512. Accordingly, the potential difference between the iron core 502 and permanent magnets 504 and 506 and the secondary coil 512 is smaller than the potential difference between the secondary coil 512 and the auxiliary core 508, so that production of the treeing can be suppressed.

The cylindrical dummy coil 513 is wound without break after the secondary coil 512 is wound to provide the connecting section with a sufficient surface facing the low tension components easily without additional manufacturing step.

Each of the secondary coil 512, the dummy coil 513, the terminal pin 27 and the terminal plate 34 has each thermal expansion coefficient different from the epoxy resin 29, and a portion of the epoxy resin in contact with those components may crack. Particularly, the portion in contact with a sharp corner of the terminal pin 27 or the terminal plate 34, if any, may likely to crack. If such portion cracks, the treeing is likely to grow.

The primary spool 514 covers the high tension side of the secondary coil 512, the dummy coil 513, the terminal pin 27 and the terminal plate 34. In addition, the lower end 514*d* of the primary spool projects in the axial direction toward the spark plug from an imaginary straight line between the circumference of the high tension terminal (the terminal pin 27 and the terminal plate 34) and the lower end of an auxiliary core 508, thereby shielding the high tension terminal from the low tension components. As a result, when the treeing grows in the epoxy resin 29 from the high tension terminal toward the auxiliary core 508 and extends to the primary spool 514, the head of the treeing turns to extend along the boundary between the epoxy resin 29 and the primary spool 514. As a result, time for the treeing to reach the auxiliary core 508 increases, in other words, time of the electric breakdown is delayed.

The secondary coil can be disposed around the primary coil, and the control circuit section 7 of the first embodiment can be removed from the case 100 of the ignition coil 2.

Figure 3:
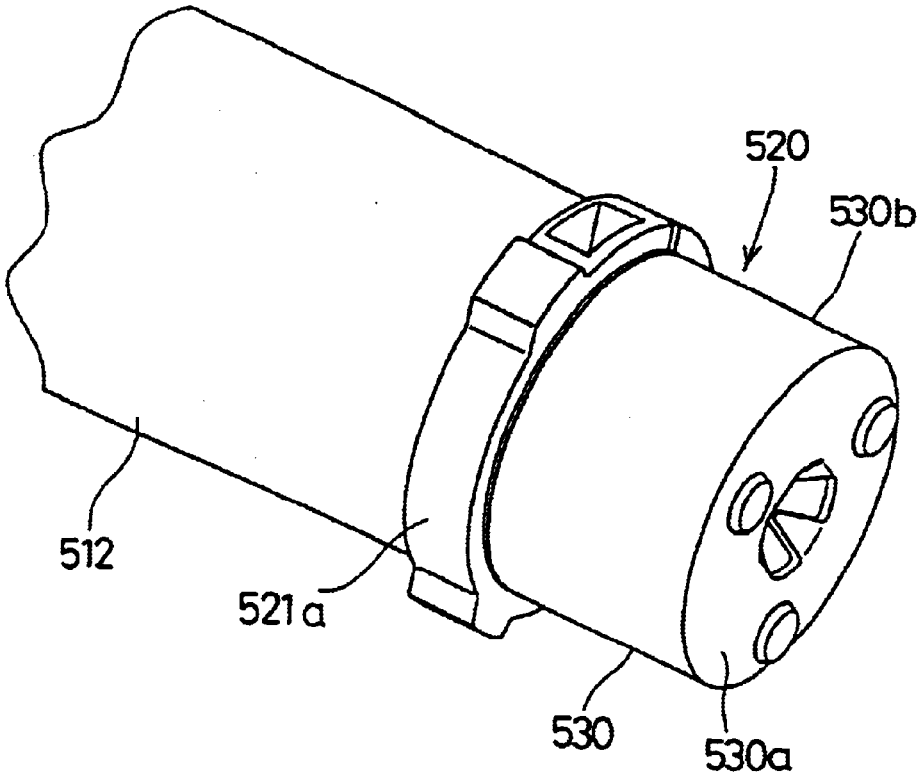
FIG. 3 is a perspective view illustrating a secondary coil, a connecting member and a high tension terminal of an ignition coil according to a second embodiment.
Figure 4:
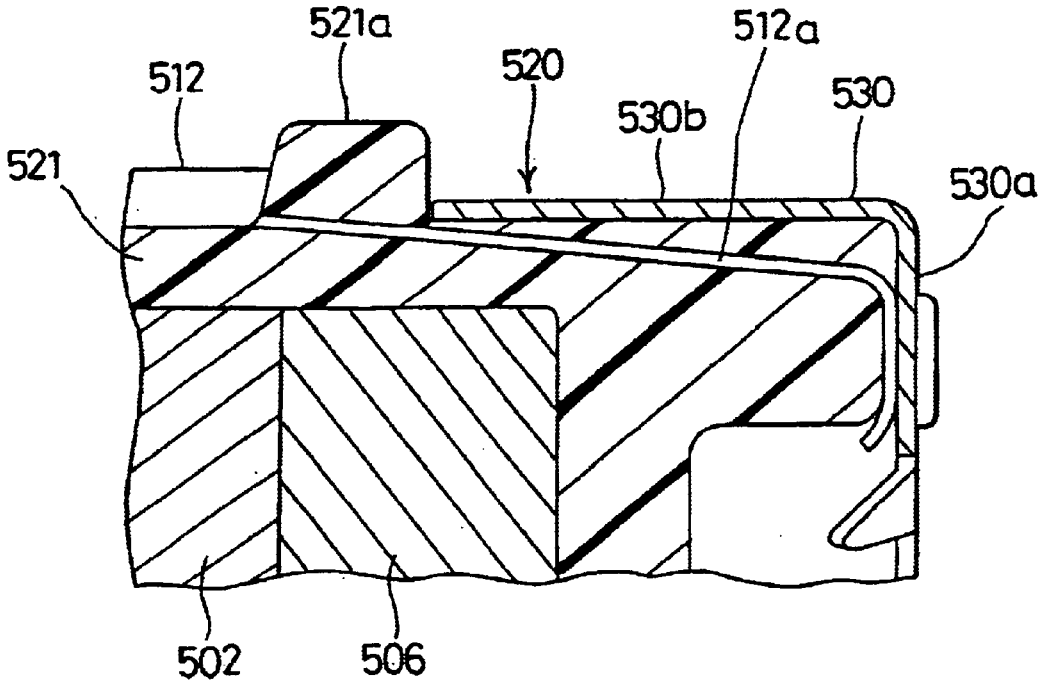
FIG. 4 is a sectional view illustrating the portion illustrated in FIG. 3.

An ignition coil according to a second embodiment is described with reference to FIGS. 3 and 4.

The secondary coil 512 and a cup-shaped high tension terminal 530 are connected by a wire 512*a* extending from the secondary coil 512. The high tension terminal 530 is made of resilient conductive plate member and has a round bottom portion 530*a*, to which a coated wire 512*a* is connected after removing the insulating coating thereof and a cylindrical portion 530*b* projecting from the bottom portion 530*a* toward the secondary coil 512 to a flange 521*a*. The cylindrical portion 530*b* is disposed in the spacer portion 520 the wire 512*a* to have substantially the same potential as the wire 512*a*.

The wire 512*a* connecting the secondary coil 512 and the bottom portion 530 is surrounded by the conductive cylindrical portion 530*b* which faces the low tension components. The cylindrical portion 530*b* has much larger surface area facing the low tension components, so that the electric field strength around the cylindrical portion 530*b* can be moderated to be much smaller.

Since the high tension terminal 530 is made of resilient conductive material, the spacer portion 520 including the wire 512*a* can be covered easily irrespective of the shape of the spacer portion 520.

Figure 5:
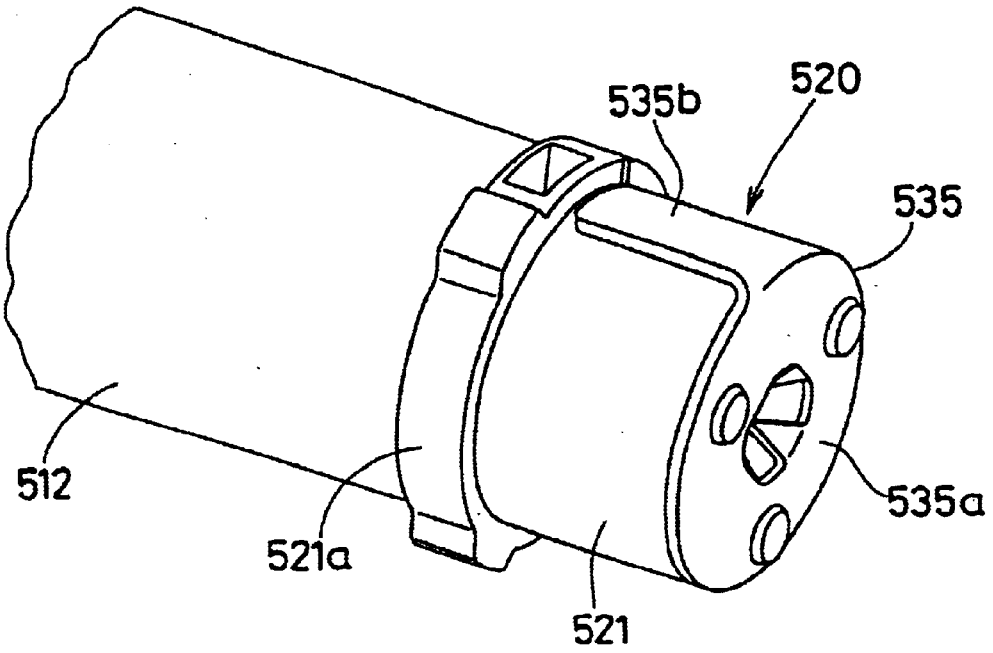
FIG. 5 is a perspective view illustrating a secondary coil, a connecting member and a high tension terminal of an ignition coil according to a third embodiment.

An ignition coil according to a third embodiment is described with reference to FIG. 5.

A high tension terminal 535 is composed of a conductive round bottom portion 535*a* and a conductive nail portion 535*b* extending from the bottom portion 535*a* toward the secondary coil 512. The bottom portion 535*a* is connected to the secondary coil 512 by a wire (not shown). The nail portion 535*b* has a suitable width and is disposed near the wire, preferably, to shield the wire entirely from the low tension components.

Since the nail portion 535*b* provides a surface area facing the low tension components with the high-tension-side spacer portion 520 of the ignition coil, the electric field strength is moderated.

Figure 6:
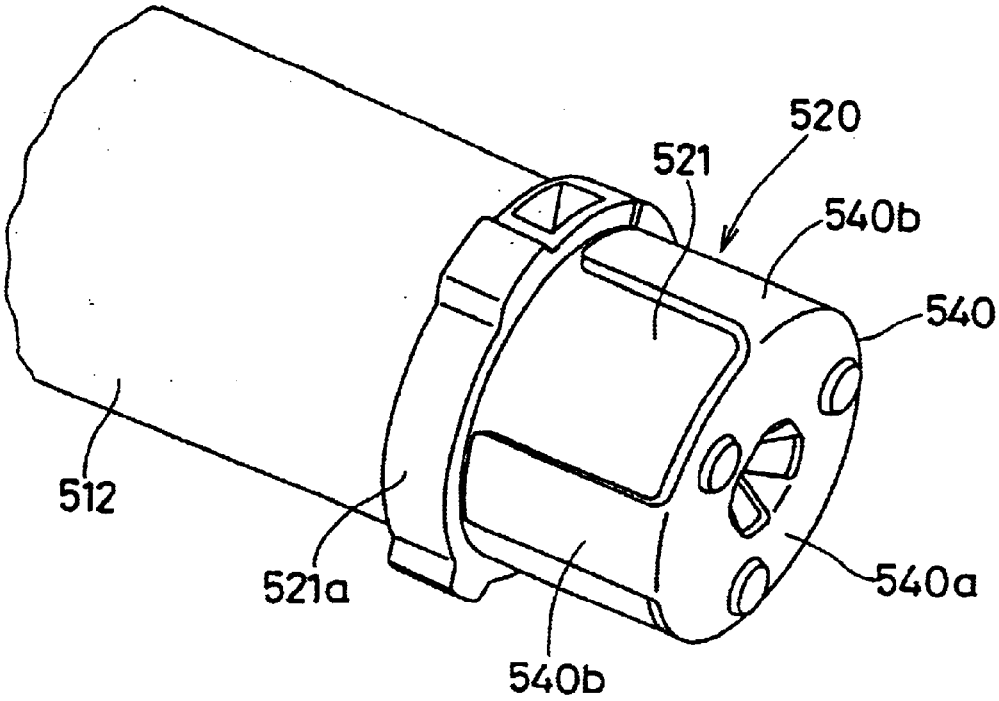
FIG. 6 is a perspective view illustrating a secondary coil, a connecting member and a high tension terminal of an ignition coil according to a fourth embodiment.

An ignition coil according to a fourth embodiment of the present invention is described with reference to FIG. 6.

The high tension terminal 540 is composed of a conductive round bottom portion 540*a*, a plurality of conductive nail portions 540*b* extending toward the secondary coil 512 from the bottom portion 540*a*. The bottom portion 540*a* is connected to the secondary coil 512 by a wire (not shown) extending from the secondary coil 512.

The conductive nail portions 540*b* provide wider surface area facing the low tension components with the high-tension-side spacer portion of the ignition coil. Accordingly, the electric field strength is moderated, so that the electric breakdown can be prevented even if the nail portion 540*b* does not cover the wire completely.

Instead of the wire described above, a portion of the high tension terminal can be extended to be directly connected to the secondary coil.

Figure 7:
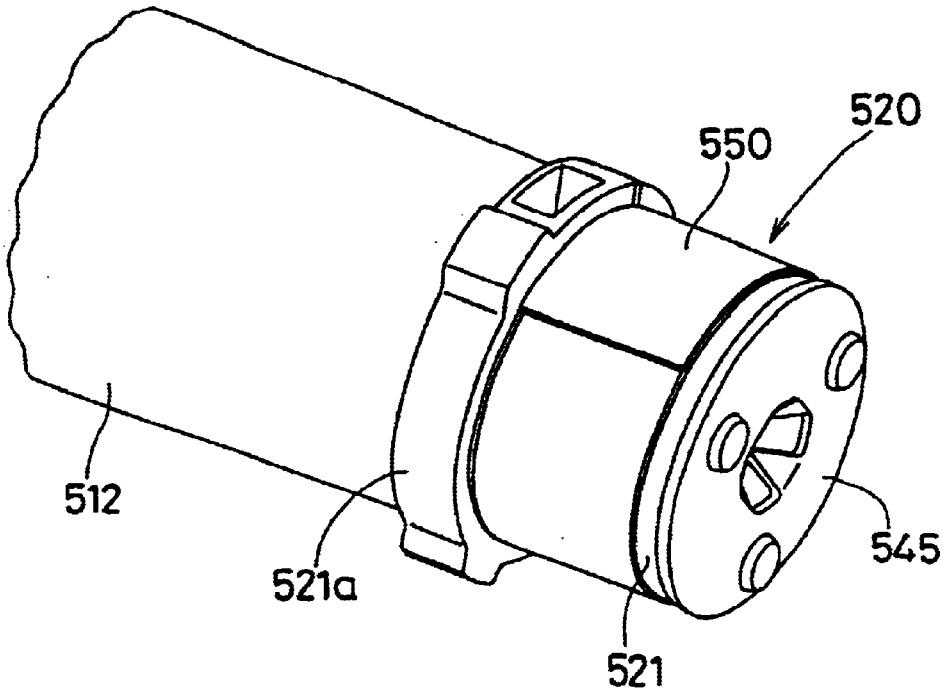
FIG. 7 is a perspective view illustrating a secondary coil, a connecting member and a high tension terminal of an ignition coil according to a fifth embodiment.

An ignition coil according to a fifth embodiment of the present invention is described with reference to FIG. 7.

A disk-like high-tension terminal plate 545 is connected to the secondary coil 512 by a wire (not shown) extending from the secondary coil 512. A conductive tape 550 made of a thin conductive film covers the spacer portion 520. The conductive tape 550 is insulated from the secondary coil 512 and the terminal plate 545 by a secondary spool 521. Since the conductive tape is insulated from the secondary coil 512 and the terminal plate to float, a voltage slightly lower than the voltage of the wire is induced. The conductive tape 550 covers the wire and provides much wider surface area facing the low tension components, thereby moderating the electric field strength. The conductive tape 550 can be connected to the terminal plate 545.

Figure 8:
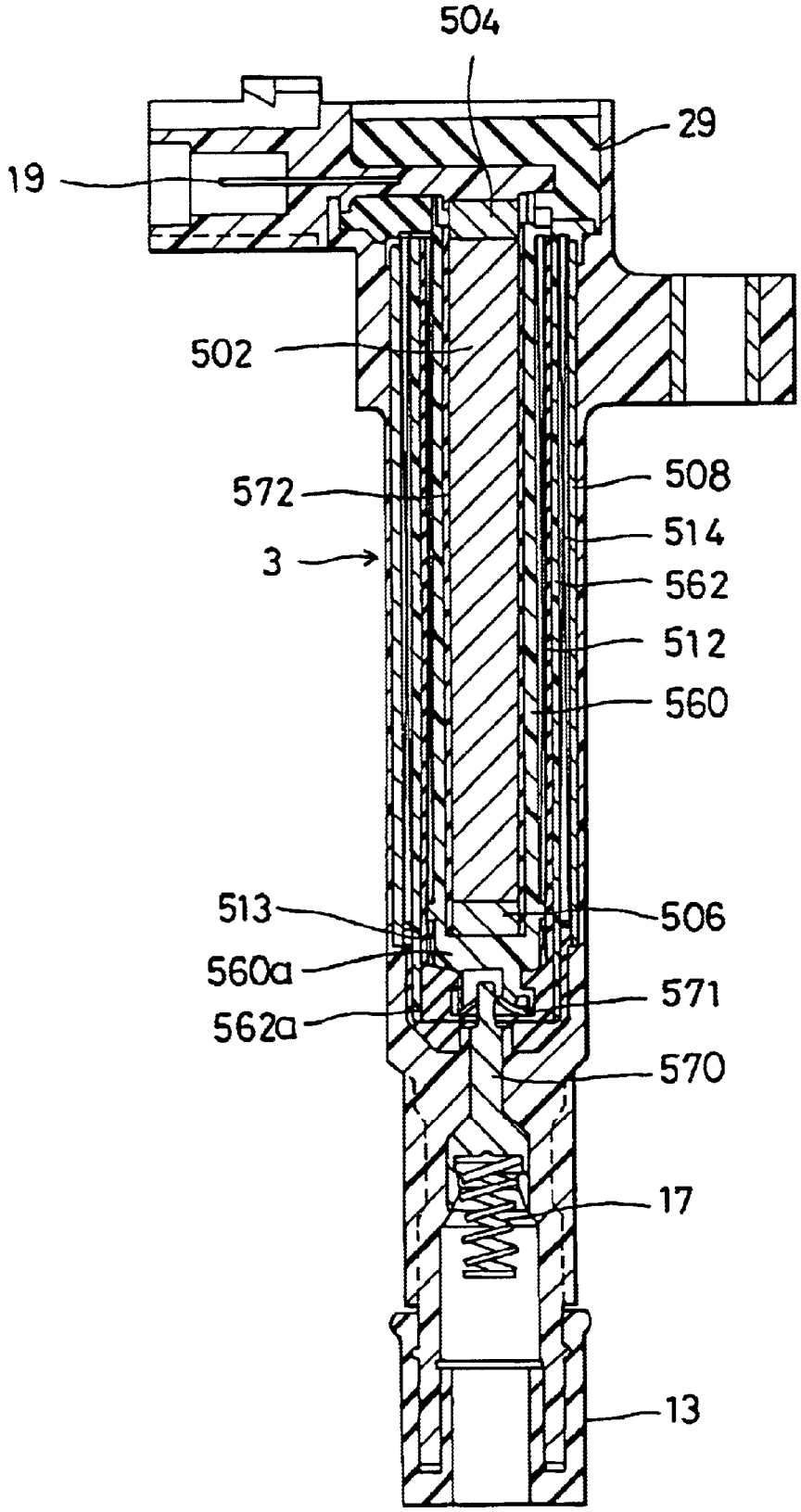
FIG. 8 is a sectional view illustrating an ignition coil according to a sixth embodiment.
Figure 9:
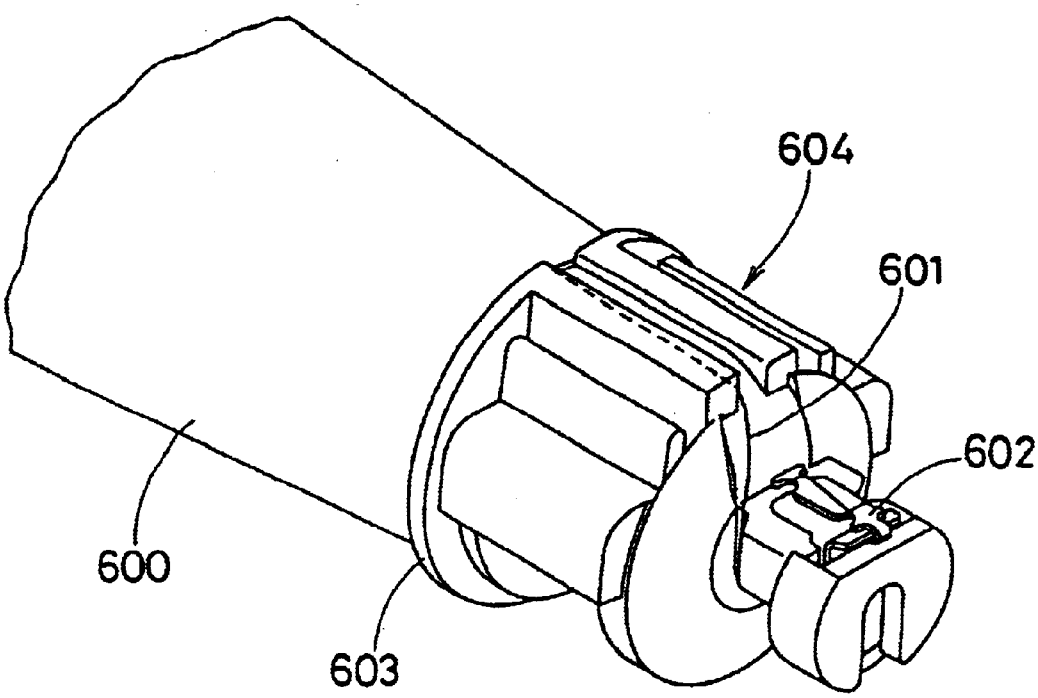
FIG. 9 PRIOR ART
FIG. 9 is a perspective view illustrating a second coil a connecting member and a second terminal of a conventional ignition coil.

An ignition coil according to a sixth embodiment is described with reference to FIG. 8.

The ignition coil 3 according to the sixth embodiment does not have the control circuit section therein. A primary spool 562, which covers the secondary coil 512, has an end 562*a* projecting in the axial direction from an end 560*a* of a secondary spool 560 at the high tension side thereof. The primary spool 562 covers portions of a high tension terminal member 570 and a terminal plate 571 immersed in the epoxy resin 29.

The primary spool 562 is made of a material which is adhesive to the epoxy resin 29 such as polyphenylether (PPE), polystyrene (PS) or polybutylene terephthalate (PBT).

When the treeing grows from a crack and extends in the epoxy resin 29 from the high tension side toward the auxiliary core 508 of the low tension components to reach the primary spool 562, the head of the treeing turns to extend along the boundary between the epoxy resin 29 and the primary spool 562 which have different dielectric constant. Since the primary spool 562 is made of a material which is bonded to the epoxy resin 29 at a high adhesive strength, the separation between the epoxy resin 29 and the primary spool can be prevented. As a result, even if the treeing grows from a crack and reaches the primary spool 562, the treeing must bypass the primary spool 562.

The iron core 502 and the permanent magnets 504 and 506 are covered by an insulating rubber member 572 to prevent the epoxy resin 29 from cracking due to thermal expansion and contraction. Thus, the treeing is prevented from growing from the high tension side toward the iron core 502.

It is possible to provide the control circuit section in the coil case in this sixth embodiment as the first embodiment. In the embodiments described above, insulating oil can be substituted for the resin.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. An ignition coil for an internal combustion engine comprising low tension components including a low tension primary coil, and high tension components including a high tension secondary coil, a high tension terminal, a connecting member for connecting said high tension secondary coil and said high tension terminal, and a control circuit connected to said primary coil for generating a high tension potential at said high tension secondary coil by intermittently supplying current to said low tension primary coil, said ignition coil comprising:

a conductive member, extending axially and circumferentially between said high tension secondary coil and said high tension terminal to have said a high tension potential, thereby providing a conductive surface area to moderate electric field strength around said connecting member, said conductive member being provided substantially from an end of said high tension coil to said high tension terminal.

2. An ignition coil as claimed in claim 1, wherein said connecting member comprises a cylindrical dummy coil longitudinally disposed between said high tension secondary coil and said high tension terminal, and said connecting member comprises said cylindrical dummy coil as said conductive member.

3. A ignition coil for an internal combustion engine comprising:

a housing to be disposed at a spark plug;

a columnar core;

a secondary spool disposed around said columnar core;

a secondary coil wound around said secondary spool;

a primary spool disposed around said secondary spool;

a primary coil wound around said primary spool;

a control circuit connected to said primary coil for generating a high tension potential at said secondary coil by intermittently supplying current to said primary coil;

a high tension terminal disposed axially distant from an end of said columnar core and connected to said secondary coil; and an insulating resinous filler having a dielectric constant different from said primary spool disposed in said housing, wherein said primary spool comprises a shielding portion projecting axially from an end of said secondary spool to cover said high tension terminal immersed in said insulating resinous filler, and said primary coil is not wound on said shielding portion of said primary spool.

4. An ignition coil for an internal combustion engine comprising:

a casing disposed at a spark plug;

a columnar core;

a secondary spool disposed around said columnar core;

a secondary coil wound around said secondary spool;

a primary spool disposed around said secondary spool;

a primary coil wound around said primary spool;

an auxiliary core disposed around said primary coil;

a control circuit connected to said primary and secondary coils for generating a high tension potential at said high tension secondary coil by intermittently supplying current to said low tension primary coil;

a high tension terminal disposed axially distant from an end of said columnar core and connected to said secondary coil; and an insulating filler having a dielectric constant different from said primary spool disposed in said casing; wherein said primary spool comprises a shielding portion projecting longitudinally from a straight line between an end of an outer periphery of said high tension terminal immersed in said insulating filler and an end of an inner periphery of said auxiliary core and said primary coil is not wound on said portion of said primary spool.

5. An ignition coil as claimed in claim 3, wherein said primary spool is made of material adhesive to said insulating resinous filler.

6. An ignition coil as claimed in claim 4, wherein said columnar core has a permanent magnet at an end thereof near said high tension terminal.

7. An ignition coil as claimed in claim 3, further comprising:

a connecting member for connecting said secondary coil with said high tension terminal, wherein:

said connecting member comprises a conductive member, extending axially and circumferentially between said secondary coil and said high tension terminal and having a high tension potential, for providing a conductive surface area to moderate electric field strength around said connecting member.

8. An ignition coil for an internal combustion engine comprising:

a casing to be disposed at a spark plug;

a transformer section disposed in said casino, said section having a longitudinally extending low tension primary coil wound on a primary spool and longitudinally extending high tension secondary coil wound on a secondary spool;

a control circuit connected to said primary and secondary coils for generating a high tension potential at said high tension secondary coil by intermittently supplying current to said low tension primary coil;

a high tension terminal disposed in said casing;

a connecting member, disposed in said casing, for connecting said high tension secondary coil to said high tension terminal; and a conductive member, extending longitudinally and circumferentially between said high tension secondary coil and said high tension terminal to provide a conductive surface having said high tension potential, for moderating electric field strength around said connecting member, said conductive member being extended substantially from an end of said secondary coil to said high tension terminal.

9. An ignition coil as claimed in claim 8, wherein:

said high tension terminal comprises a portion longitudinally extending therefrom to cover said connecting member; and said conductive member comprises said portion of said high tension terminal.

10. An ignition coil as claimed in claim 9, further comprising:

a columnar core disposed inside said secondary spool;

an insulating resinous member having a dielectric constant different from said primary spool covering said high tension secondary coil, said conducting member and said high tension terminal, said high tension secondary coil being disposed between said low tension primary coil and said columnar core.

11. An ignition coil as claimed in claim 10, wherein said primary spool comprises a member projecting longitudinally from said secondary spool to cover said high tension terminal.

12. An ignition coil as claimed in claim 10, further comprising an auxiliary core disposed around said primary coil, wherein:

said primary spool has a portion projecting from a straight line between a high tension end of an outer periphery of said high tension terminal immersed in said insulating resinous member and an end of an inner periphery of said auxiliary core.

* * * * *